United States Patent [19]

Fiore

[11] 4,018,234

[45] Apr. 19, 1977

[54] MECHANICAL LIPID REMOVAL FROM TOBACCO LEAVES

[75] Inventor: Joseph V. Fiore, Fairfield, Conn.

[73] Assignee: AMF Incorporated, White Plains, N.Y.

[22] Filed: Mar. 6, 1975

[21] Appl. No.: 556,025

[30] Foreign Application Priority Data

Mar. 8, 1974 United Kingdom ..... 10470/74

[52] U.S. Cl. ..... 131/140 B; 131/143; 131/147 A

[51] Int. Cl.[2] ..... A24B 3/18; A24B 15/00

[58] Field of Search ..... 131/143, 123, 145, 146, 131/147 R, 147 A

[56] References Cited

UNITED STATES PATENTS

| | | | |
|---|---|---|---|
| 534,147 | 2/1895 | Fries | 131/123 |
| 543,143 | 7/1895 | Underwood | 131/123 |
| 3,526,015 | 9/1970 | Nappi | 15/36 |

*Primary Examiner*—Robert W. Michell
*Assistant Examiner*—V. Millin
*Attorney, Agent, or Firm*—George W. Price; Charles J. Worth

[57] ABSTRACT

Operations for the reduction of lipid content in tobacco compositions with retention of favorable organoleptic properties comprising particularly treatments or the selective removal of 'neutral' lipid fraction. Tobacco leaves, preferably freshly harvested, are subjected to physical treatment adapted to remove lipid material from glandular trichome and cuticle while retaining the structural integrity of the leaf. Tobacco compositions based upon treated leaf structures exhibit significantly reduced lipid levels, reported to interrelate with production of aromatic hydrocarbons upon pyrolysis.

7 Claims, 1 Drawing Figure

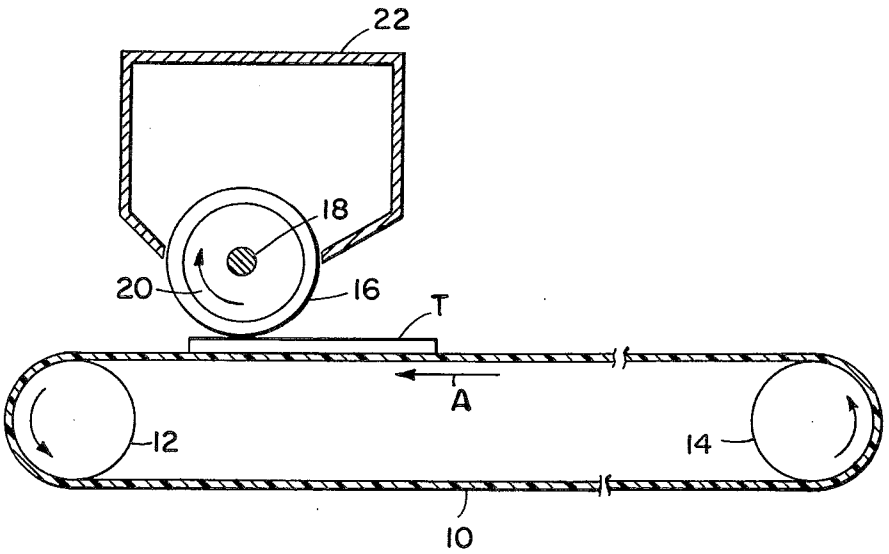
22
18
16
20
T
A
12
14
10

MECHANICAL LIPID REMOVAL FROM TOBACCO LEAVES

BACKGROUND OF THE INVENTION

Elements of the tobacco plant are known to comprise a proportion of lipids, a component of varying composition, variously defined but most commonly referenced for convenience as included within the hydrocarbon solvent extractables, e.g. from petroleum ether or hexane.

Recently lipids have occasioned interest in the continuing analysis of health related aspects of the use of tobacco. Specifically, it has been suggested that the hydrocarbon solvent solubles contribute to the generation of polynuclear aromatic hydrocarbons during leaf pyrolysis. Experimental results demonstrate that about 70% of the aromatic hydrocarbons, ranging from benzene to benz($\alpha$)pyrene in the pyrolysates, are due to leaf components extractable with hexane and acetone, although these extracts amount to less than 25% of dry leaf weight. See "Studies on the Pyrogenesis of Tobacco Smoke Constituents: A Review" Chortyk, O. T. and Schlotzhauer, W. S. Beitrage zur Tabakforschung (Vol. 7, No. 3, Nov. 1973, pp. 165–177).

There are numbers of lipid fractions characterized by the extraction technique characterized by the extraction technique employed. The neutral lipids (commonly defined by high solubility in chloroform) form the major portion of tobacco leaf lipid material, comprising about 60–75% of the total. (Further, leaf comprises the highest proportion of lipids, at 6–8% absolute in lamina, compared to about 1% absolute in stalk and midribs, respectively). Unfortunately, any solvent extraction inevitably removes additional chemical substituents, often those which contribute favorably to taste and aroma. Accordingly, other methods for lipid removal are of interest.

A proportion of lipids may be observed on tobacco leaf surfaces and, in general, their composition is somewhat different than the so-called internal lipids. It is these surface lipids which are commonly referred to as neutral lipids, resins or waxes, and are generally associated with the glandular trichomes (hairs) which cover the leaf surface and the cuticle layer just beneath these hairs.

BRIEF DESCRIPTION OF THE INVENTION

This application relates to operations for the reduction of lipid content in tobacco compositions with retention of favorable organoleptic properties, comprising particularly treatments for the selective removal of 'neutral' lipid fraction. In accordance with the invention, tobacco leaves, preferably freshly harvested, are subjected to physical treatment adapted to remove lipid material from glandular trichome and cuticle while retaining the structural integrity of the leaf. Tobacco compositions based upon treated leaf structures exhibit significantly reduced lipid levels, reported to interrelate with production of aromatic hydrocarbons upon pyrolysis.

More specifically, the present invention comprehends modifications in leaf harvesting and handling techniques whereby generally freshly harvested leaf (i.e. before significant drying, curing or fermentation has occurred other than as a natural consequence of the harvesting operation) is subjected to physical treatment specifically adapted to remove surface lipids.

These surface lipids are in adherent contact with and/or protected by the surface hairs or glandular trichome characteristic of the tobacco leaf. Accordingly, simple physical contact does not effect more than casual pick-up and hence an insignificant modification, typical of that accomplished in the ordinary course by operator handling.

It is an object of the present invention to provide a significant lipid reduction i.e. 25% or so, preferably as much as 40% and accordingly techniques have been refined for this purpose. Combing or brushing steps, sometimes reported as of value in removing debris such as dirt or larvae from tobacco leaves (see, for example, U.S. Pat. Nos. 973,228 and 1,831,953) are of limited value in the present sense, although may be employed as an initial phase for better presentation of the tobacco leaf structure to the inventive operation herein described.

According to this invention, the tobacco leaf, presented in a supple supported condition at high moisture content (free of significant detritus) is passed through a zone in which, under controlled conditions to maintain the structural integrity of the tobacco leaf while maximizing availability and release of surface lipids, the leaf is subjected to light non-abrasive pressure contact with a porous, absorbent surface. Suitably, the operative surface may comprise a soft woven fabric or foam presented as a surface of revolution about a roller displaceable into pressure contact with the plane of translation of the supported leaf. In a convenient embodiment, the discrete leaf structures are deposited upon a transfer belt for conditioning, if necessary, and transferred to the nip of a pair of rollers carrying thereupon or thereabout the absorbent medium.

In selected embodiments, combing or brushing means may be utilized in an interacting manner, such that the trichome structure is held in a relatively extended state at, or just prior to, the action of the absorbent surface in a manner further described hereinbelow.

Where continuous operation is involved, a further embodiment calls for the use of an absorbent surface of significant length or surface of revolution such that a portion or arc thereof may be subjected, in the course of continuous, recirculatory travel, to the action of cleaning, drying and optionally (in the case of a loose, supported fiber structure) fluffing means, such that collected lipid may be removed and fresh absorbent surface presented to the sequentially provided leaves. In such an arrangement, it is convenient to provide a chambered section intersecting a portion of travel of the belt or roll carrying the absorbent surface in which section or enclosed zone an extractive atmosphere may be provided, for example constituted by a suitable level of chloroform. It is of course also in prospect that the absorbent surfaces can be cycled over a finite term and then removed for the same type of 'dry-cleaning' and optionally washing sequence, as appropriate.

It may be desirable, having regard for the varieties of tobacco leaves which may be successfully treated in accordance with the present invention, to employ a preconditioning sequence to insure an adequate response level in the leaf structure. Such a treatment may vary from the provision of a suitable moisture level to guarantee the requisite suppleness for the physical treatment involved, to a deliberate increase in moisture level over equilibrium, or the introduction of organic solvents or surface active agents. While the effect of agents for lipid solvation must be carefully controlled having regard for potential reduction in desirable solubles, a minor proportion of organic additament, e.g. 0.1–20% of the vapor in the preconditioning zone may aid in removal of lipids from the trichome structure.

Thus, in a complete sequence, freshly harvested tobacco leaf is preconditioned and treated as per the above description and the equipment recycled for continuous use. The treated leaf is free of structural degradation based upon physical manipulation or chemical extraction and accordingly provides a structure most naturally adapted to use in compositions for smoking with retention of the organoleptic qualities most sought after in such milieu. Most importantly, lipid levels are quantitatively reduced by as much as 40%, with attendant consequence in the pyrolytic environment afforded by conventional smoking articles.

The tobacco compositions prepared by the utilization of the treated tobacco leaves described herein offer low lipid level together with retained structural and chemical characteristics, in other respects affording an opportunity for the delivery of satisfactory organoleptic smoke quality with materially reduced aromatic hydrocarbons as per the reported literature.

Impact upon reconstituted formulations is also seen, as the treated, cured and fermented leaves prepared hereunder may form a portion of or substrate for reformulation as by solvent re-addition of tobacco solubles to a pellicle constituted therewith, modified by addition of dust or shred, stem or stalk in comminuted form. In this and other contextual respects herein, it is believed understood that burning characteristics as a factor in pyrolysis are significantly determined by physical characteristics such as openness or fineness of structure as well as by gross chemical differentiation. The major retention of the original tobacco internal structure by the present process, at reduced lipid levels, is suggested as significant in this regard.

The major relationship to taste and aroma evidenced by cigar wrapper affords a vehicle for ready impact of the present low lipid form of tobacco leaf compositions, particularly having regard for retained aesthetics. It may be observed that the improvements afforded by the present invention can be carried forward into the comminuted form as well, and accordingly structures wherein comminuted leaf prepared as described herein is employed in the manner described in copending and commonly assigned application Ser. No. 428,949 now U.S. Pat. No. 3,872,871 are contemplated.

Reference has been made significantly to freshly harvested leaves as the most efficacious manner of achieving the benefits of this invention, but it is to be understood that concomitantly with other modifications in responsiveness, and chemical and physical structure, cured and/or fermented leaf may be employed, particularly in a preconditioned state.

Curing is understood to affect lipid level ("Lipid Content of Cured Tobacco" Wassef et al Can J. Bot, Vol. 52 (1974), pp. 1123–1126) but significant neutral lipid content is retained and thus flue-cured and burley types for example are specifically envisaged for treatment in accordance with the invention. It is understood, of course, that the removal of surface lipids from cured leaf or cured and fermented leaf becomes increasingly more difficult because of their assimilation into the structural entity of the leaf as dehydration proceeds. Maximization of removal prospects is achieved at higher moisture levels accomplished in the preconditioning phase.

BRIEF DESCRIPTION OF THE DRAWING

Reference may now be had to the following detailed description of the invention, taken in conjunction with the single FIGURE of drawing illustrating schematically an apparatus for effectuating the selective removal of surface lipids from tobacco leaves.

SPECIFIC DESCRIPTION OF THE INVENTION

In a preferred embodiment, freshly harvested tobacco leaves are passed into a conditioning zone constituted by a chamber in which moisture laden air is maintained at moderate to cool temperatures e.g. from about 40° to 75° F. The relative humidity is typically above 50%, usually 75–85% or more. In the case of continuous operation the zone may be traversed by a conventional conveyor assembly from which the leaves are hung or upon which they are placed, or in other embodiments the leaves may be maintained in a static manner until the desired stage of treatment.

The treatment zone ordinarily involves one or more coacting rolls or recirculating endless belts which are arranged in such manner as to permit light pressure contact with the supported leaf. In the case of single roll treatment the leaf will be supported horizontally or vertically against or upon a generally planar surface. It is important that abrasive contact with the leaf structure be avoided, hence the treatment and support surfaces are urged together resiliently under a controlled pressure. Further, in the case of continuous treatment of individual leaves traversing the treatment zone in a translatory manner as by transport upon a conveyor, the action of the treatment surface is timed and arranged such that no significant abrasive dragging contact is permitted i.e. a roll or belt is provided with a surface speed approximating the movement of the leaf. Typically the roll or belt is not driven, and motion is effected by frictional forces upon contact, hence low inertia rolls journalled into support structures employing recirculative ball bearings are preferred. Obviously multiple rolls urged into mating contact may operate together to provide the same effect.

Referring to the drawing, there is shown an endless belt 10 entrained about drive rollers 12 and 14 driven from a suitable power source (not shown). The belt 10 is preferably constituted of a cotton fiber material end adapted to support a tobacco leaf T thereon for conveyance in the direction of arrow A.

Juxtaposed above the upper run of the endless belt 10 is the freely rotatable roller 16, in effect, loosely journalled on shaft 18 so as to rotate responsive to being contacted in sliding frictional engagement by the tobacco leaf T transported on belt 10. The roller 16 is preferably constituted of a polyurethane material 20 having a generally soft outer peripheral surface.

Superimposed upon the roller 16 is an open-bottomed receptacle 22 adapted to receive a supply of an organic solvent vapor which will permeate sequential segments of the roller surface upon the latter passing through the receptacle 22, whereby said roller surface is cleansed of lipid material.

The leaves may be treated sequentially or in small groups by contact with the absorbent surface. Most conveniently a belt structure of significant length e.g. 10 to 20 ft. carried on two or more rolls is placed in resilient contact with the support means, and several leaves are treated simultaneously.

The absorbent surface may be constituted by any soft material capable of absorbtive or adsorptive action in a moist environment. Commonly, fibrous material of somewhat hydrophilic nature is employed such as cotton, rayon or cellulose acetate, but foam or sponge structures are also operable. Porous materials or those of some wicking action are preferred for continuous operations. The structure of the surface will of course vary, but should be capable of holding substantial quantities of moisture and entrained materials as in the degree represented by a common household paint roller. Selection of suitable materials may be made among natural and man-made or synthetic fibers, in interwoven or interentangled form as knit or woven fabrics or non-woven webs or as napped or cut pile structures; natural and synthetic foams such as sponges, foam or rubber and foamed polyurethanes; and the like.

The treatment phase proceeds at temperatures ranging from a chilled condition e.g. about 40°–50° F to about 150° to 160° F during an exposure of the leaf for a period of from less than one up to 30 seconds. If desired, the leaf may be treated sequentially in a series of similarly conditioned zones. High moisture levels of the leaf are required during processing, at a minimum of 35%.

The pressures employed will vary with the nature of the epithelial tissue presented by the particular tobacco leaf, but is established in each case at a level insuring the absence of any appreciable compression of the leaf. It therefore is obvious that the amount of pressure will be mainly dictated by the stage of processing of the tobacco leaf i.e. less pressure is applied to a freshly harvested leaf than to a cured or cured and fermented leaf.

As earlier noted, the absorbent padding step may be usefully conducted while the hair like trichome structure is at least partially extended, to permit better access to the cuticle. This effect may be accomplished by applying a surface vacuum at or just before entry to the padding zone, but is more readily accomplished by establishing a vacuum condition interiorly of a treating roll such that the trichome structure is positively intermeshed with the absorbent surface and additional energy is directed to the removal of the surface lipids. (Obviously, in this instance the roll surface underlying the absorbent material is at least partly foraminous). A combing or brushing action at or into the treatment zone can aid in the same manner, by requiring maximum interaction between leaf structure and absorbent surface.

It is understood that a sequence of treating steps may prove beneficial in given cases, so that, for example, it is within the contemplation of this invention that an initial padding treatment would be conducted at maximum moisture content, and subsequent padding would follow soaking, with or without ultrasonic agitation in a water-organic solvent bath, etc. In either case, the treated leaf is passed to subsequent operations in the ordinary course eventually to be processed into cigars as sheet, cigarettes as shred or comminuted for smoking or chewing tobacco.

Any tobacco leaves commonly utilized in the smoking arts may be satisfactorily handled in the manner of the invention, and may be treated directly in the harvesting operation or reserved for late processing, preferably with a minimum of manipulation. Most desirably, the leaf is treated within a 24 to 36 hour period, and is maintained in a humid ambient condition until completion of the operation.

Tobacco articles for smoking commonly exhibit an equilibrium moisture level not in excess of about 20% by weight, ordinarily in the range of 12 to 15%, whereas freshly harvested leaf may contain up to 90% moisture, with dehydration effected over the term of curing, as aforesaid. For the purpose of this invention, the leaf presented for treatment should comprise at least 35% moisture, preferably about 50%–70% moisture.

In the event the leaf requires conditioning to achieve or preserve the desired moisture level, it may be maintained in, or passed through a zone in which humidity is controlled, generally at relatively cool ambient temperatures usually not greater than about 80° F. As noted previously, the process may also comprise a step for applying a surface active agent e.g. polyoxyethylene sorbitan fatty esters, or quaternary salts e.g. cetyl pyridinium bromide to the leaf as in a spray. Similarly, organic solvents such as petroleum ether, or hexane and particularly polar materials and/or isopropanol and/or ethanol, may be employed to aid in lipid availability and removal.

Where removal of polar tobacco solubles is acceptable the leaf may also be conditioned by passage through a water bath. Further, the conditioning and treatment zones may be merged such that the absorbent surface is applied to the leaf at or beneath the surface of the liquid bath. In selected embodiments, the surface treatment may be aided by ultrasonically agitating the medium.

The invention is further illustrated in the following Examples.

EXAMPLE 1

Leaves of freshly-harvested Virginia Bright tobacco having an average moisture content of about 85%, are placed flat, upper surface exposed, at spaced locations upon a 24 inch wide cotton-twill endless belt travelling at a speed of 10 feet to 20 feet/minute through a zone maintained at about 120° F by radiant heating lamps. During the travel of the leaves through said zone, they are gently contacted by soft polyurethane rollers about 8 inches in diameter which are not mechanically driven. The contact pressure of the roller on the moving leaves and belt is such as to cause rotation of the rollers at a speed approximately equal to the speed of the moving belt. Visual examination at the point of leaf-roll contact insures that no undesirable compression of the leaf occurs. Under these conditions, the surface lipids on the leaves are mechanically transferred to the cotton belt and/or to the polyurethane rollers.

Samples of unprocessed leaves (control) and processed leaves are dried, ground and analyzed for total lipid content using hexane/ethanol azeotrope (82:18, v/v, b.p. 59° C) in a Soxhlet-type extractor over a period of 24 hours. The unprocessed leaves show a lipid content of 7.78% while the processed leaves exhibit a lipid content of less than 5% representing a decrease of approximately 40% in total lipids.

The treated tobacco materials may be characterized by provision of substantially reduced surface, or 'neutral', lipid levels, without substantial internal structural degradation, and retention of internal lipids and satisfactory organoleptic quality upon smoking. Smokable articles constituted at least in part of these novel tobacco structures reflect in use these desirable aspects and are accordingly a featured aspect of the present invention. It has been suggested that the presence of certain trace contaminants, often metals and sometimes radioactive components, are present in smoking compositions as a result of capture from air pollution, specifically occlusion in and upon the adhesive surface of the tobacco. It is perceived that treatment in accordance with the present invention will permit reduction in these materials since a significant proportion of the occluded material will likely be associated with the surface lipids removed.

What is claimed is:

1. A process for the selective removal of surface lipids from tobacco leaves comprising contacting the epithelium of whole tobacco leaf in a supple supported condition at a moisture condition of at least 35 percent by weight with means for mechanical disengagement and release of surface lipids associated with the glandular trichome and cuticle, comprising an absorbent surface said contacting being effected in a nonabrasive manner without substantial relative movement between said leaf and said surface and recovering tobacco leaf characterized by substantial retention of physical and chemical integrity and a lipid content reduced as compared to untreated leaf by at least 25%.

2. The process of claim 1, wherein said absorbent surface is composed of foam or fiber.

3. The process of claim 2, wherein said absorbent surface is formed about a surface of revolution for continuous recirculatory employment.

4. The process of claim 1, wherein said contacting is carried out in a zone maintained at a temperature of 40° to 160° F, and said leaf is maintained in pressure engagement without appreciable compression thereof for a period from less than one second up to 30 seconds.

5. The process of claim 1, wherein a multiplicity of leaves are presented for treatment in sequence.

6. Tobacco leaf of reduced lipid content recovered in the method of claim 1.

7. A process for the selective removal of surface lipids from tobacco leaves comprising contacting a multiplicity of whole freshly harvested tobacco leaves in sequence in a supple supported condition at a moisture condition of at least 35 percent by weight with an absorbent surface said surface being continuously deployed in a recirculatory manner into and out of engagement with said leaves, and into and out of engagement with cleaning means for removal of absorbed lipid with an organic solvent therefore, said contacting being effected in a non-abrasive manner without substantial relative movement between said leaf and said surface and recovering tobacco leaf characterized by substantial retention of physical and chemical integrity and a lipid content reduced as compared to untreated leaf by at least 25%.

* * * * *